US005409580A

United States Patent [19]

Gesing et al.

[11] Patent Number: 5,409,580

[45] Date of Patent: Apr. 25, 1995

[54] PROCESS AND APPARATUS FOR MELTING METALS AND COMPOSITES WHILE REDUCING LOSSES DUE TO OXIDATION

[75] Inventors: Adam J. Gesing, Kingston; Alan D. McLeod, Yarker; Ernest W. Dewing, Kingston, all of Canada

[73] Assignee: Alcan International Limited, Montreal, Canada

[21] Appl. No.: 88,803

[22] Filed: Jul. 8, 1993

[30] Foreign Application Priority Data

Jul. 10, 1992 [CA] Canada ..... 2073625

[51] Int. Cl.[6] ..... C25C 3/02; C25C 3/04; C25C 3/06; C25C 3/08

[52] U.S. Cl. ..... 204/67; 204/68; 204/70; 204/71; 204/245; 204/274; 204/262

[58] Field of Search ..... 204/67, 68, 70, 71, 204/245, 262, 274

[56] References Cited

U.S. PATENT DOCUMENTS

| | | | |
|---|---|---|---|
| 3,846,123 | 11/1974 | Racunas et al. | 75/68 |
| 3,955,970 | 5/1976 | Claxton et al. | 75/68 |
| 4,396,481 | 8/1983 | Pawlek et al. | 204/243 |
| 4,491,474 | 1/1985 | Ormesher | 75/65 |
| 4,510,029 | 4/1985 | Neelameggham et al. | 204/70 |
| 4,551,218 | 11/1985 | Gesing et al. | 204/245 |
| 4,758,316 | 7/1988 | Stewart, Jr. et al. | 204/67 |
| 4,761,207 | 8/1988 | Stewart, Jr. et al. | 204/67 |
| 4,973,358 | 11/1990 | Jin et al. | 75/415 |
| 5,037,472 | 8/1991 | Jacobson | 75/709 |
| 5,057,194 | 10/1991 | Stewart et al. | 204/67 |

FOREIGN PATENT DOCUMENTS

| | | |
|---|---|---|
| 0101153 | 2/1984 | European Pat. Off. . |
| 2250028 | 10/1991 | United Kingdom . |

OTHER PUBLICATIONS

Qui Zhuxian et al—"Preparation of Aluminium-Magnesium Master Alloys By Electrolysis of Magnesium Oxide . . . " pp. 349-355, Light Metals 1991.

*Primary Examiner*—Kathryn Gorgos
*Attorney, Agent, or Firm*—Cooper & Dunham

[57] ABSTRACT

A process and apparatus for melting metals that react rapidly with air at elevated temperatures to form a stable metal oxide and/or that contains a metal oxide prior to being exposed to elevated temperature, while reducing metal losses due to oxidation or the presence of the oxides. The process involves melting the metal in the presence of a molten metal salt metal salt mixture while electrolyzing metal oxide contained in the salt metal salt mixture to convert the oxide to elemental metal. The process requires an metal salt mixture which contains at least 25% by weight, and more preferably 100% by weight, of metal fluoride and which, for the metal being melted, has a composition which remains substantially unchanged during the electrolysis process. The fluoride improves oxide solubility in the metal salt mixture, making it possible to increase current densities without producing anode effects. The stable composition makes it possible to use the metal salt mixture for prolonged periods without change. The apparatus consists of a single vessel having an interior volume divided at least into a melting zone and an electrolysis zone by a heat-resistant partition which allows the metal salt mixture to be recirculated between those zones. The process and apparatus can be used for melting metals, metal matrix composites reinforced by metal oxides and metal foams stabilized by metal oxide particles.

36 Claims, 5 Drawing Sheets

PROCESS AND APPARATUS FOR MELTING METALS AND COMPOSITES WHILE REDUCING LOSSES DUE TO OXIDATION

BACKGROUND OF THE INVENTION

I. Field of the Invention

This invention relates to a process and apparatus for melting metals while reducing metal losses due to oxidation and/or recovering metal values from metal oxides already present, either as contaminants or as reinforcements or stabilizing particles in certain metal matrix composites and metal foams.

II. Discussion of the Prior Art

The recycling of metals and metal products is becoming increasingly important nowadays for economic and environmental reasons. In particular, so-called "light metals", such as aluminum and aluminum alloys, are recycled on a large scale. Used metals of this kind, e.g. from beverage cans, metal scrap and metal turnings, etc., can simply be remelted and cast into re-usable ingots or the like.

In the most common present practice, the metal is melted in a reverberatory furnace fired by a fuel such as natural gas. This is a very inefficient operation due to poor heat transfer between the hot combustion gases and the metal, causing a significant fraction of the input energy simply to be lost with the exhaust gases. The process also tends to convert a significant amount of the metal to oxide (dross) by hydrolysis during the melting operation and tends to contaminate the metal with hydrogen, which makes it necessary to de-gas the metal with a nitrogen/chlorine gas mixture prior to further use. This de-gassing process in turn tends to generate more dross contaminated with chlorides.

The generation of dross in these ways represents a loss of the metal from the melting operation and should thus be avoided, if possible. Moreover, the metal to be melted is usually already coated with or contaminated by a significant amount of oxide, particularly if it has undergone a preliminary decoating operation to remove organic contaminants by heating. Furthermore, certain metal products often contain large amounts of deliberately introduced oxide particles. For example, certain metal matrix composites use alumina or other oxides as reinforcement, and stabilized metal foams (for example as produced by a process described in U.S. Pat. No. 4,973,358) may contain alumina or other oxide particles as a stabilizing medium. Oxides incorporated into the metal in this way also represent a reduction of the total amount of potentially recoverable metal available during recycling.

When metals contain "reactive" (readily oxidizable) elements, such as aluminum, magnesium and lithium, either as majority or minority components, oxidation can be a particularly significant problem. These reactive elements oxidize quickly at elevated temperatures, such as those used for de-coating and melting, and form stable oxides which cannot easily be reduced by conventional techniques, such as carbothermal reduction. In the case of such metals and alloys, it is, therefore, particularly advantageous to avoid oxidation during melting operations.

In order to reduce such losses, it has been proposed that melting could be brought about by using electrical heating means and that the metal could be melted beneath an overlying layer of a molten salt mixture, e.g. a common chloride-based salt flux. The layer of molten salt would prevent exposure of the molten metal to atmospheric moisture and oxygen and would help to separate the metal, as it melts, from coating, contained or adhering oxides because the molten salt would preferentially wet the oxide. However, when this is attempted, the oxides introduced with the metal, or formed in reduced amounts during the melting operation, quickly accumulate in the molten salt layer until the salt layer becomes too viscous to be used further, whereupon it must be discarded. It is no longer environmentally acceptable to dispose of the resulting salt cake by simply dumping it in land-fill sites, so the consequent need for special disposal arrangements would increase the cost of operating such a process. Moreover, while the process would reduce the total amount of oxide formed during the melting operation, oxide present on or in the metal prior to the melting operation and the reduced amounts produced during the melting operation would still represent a significant loss of potentially recoverable metal.

In addition to conventional metals, metal matrix composite materials reinforced with metal oxides and metal foams stabilized by metal oxides, such as alumina, are being used in increasing amounts and are also candidates for recycling. As is the case for non-reinforced or stabilized materials, conventional methods do not lead to the complete recovery of the metal values in a convenient manner. There is, therefore, a need for an improved way of recycling these newer materials.

Metal losses could theoretically be avoided or reversed during a salt flux melting process if electrolysis of the oxide contained in the molten salt layer were to be carried out at the same time as, or subsequent to, the melting operation in order to reduce the oxide present in the salt layer to the elemental metal. Any metal oxide formed during such a melting process or introduced with the metal would then be converted to the metal by electrolysis, thus avoiding product losses. However, such an electrolysis process would not be easy to carry out on the scale required for commercial metal melting operations. A main problem is that current densities would have to be kept quite low in order to avoid decomposition of the chloride electrolyte (salt flux), since this would disadvantageously result in the generation of chlorine and/or the passivation of the anode surface (phenomena often referred to as "anode effects"). Even with very modest oxide contamination (of e.g. about 1% by weight) of the metal to be melted, very substantial quantities of oxide would be introduced into the metal melter at commercially acceptable melt rates (e.g. 1 to 20 tonnes per hour). If such quantities of oxide were to be completely eliminated by electrolysis, very high electrolysis currents would be required (e.g. about 100 kA for a 1% oxide-contaminated, 5 tonne/hour scrap metal stream), and this would greatly exceed the limiting current densities at which electrolyte decomposition would commence in metal melters of commercially feasible size.

Mutually related U.S. Pat. Nos. 4,758,316, 4,761,207 and 5,057,194 to Stewart et. al., all assigned to Aluminum Company of America, disclose melting processes carried out under molten chloride-containing salt layers while carrying out electrolysis to regenerate the metal from oxides. Two approaches are adopted. In a first of these approaches, the metal oxide collecting in the chloride-containing salt layer is itself converted to metal chloride by carbo-chlorination, and then the metal chloride is electrolyzed to regenerate the metal. In this case, the electrolysis of the chloride is not restricted to a limiting current density because the decomposition of the metal chloride and the electrolyte both result in chlorine generation without anode passivation, and chlorine generation is acceptable, in this process, especially since the chlorine can be used for the carbochlorination step. However, the process suffers from the significant disadvantages that both the gaseous reactants and the gaseous products are highly toxic and include chlorine, phosgene and carbon monoxide, and that the molten electrolyte must be transferred among a series of separate reaction vessels, which results in undue complexity and unacceptable plant size.

In a second approach, Stewart et. al. have suggested that the metal oxide in the molten salt layer may be electrolyzed directly, i.e. without prior conversion to a chloride, in a vessel separate from the main melting apparatus. It appears that Stewart has addressed the problem arising from the low limiting current density by increasing the effective surface area of the anode, e.g. by forming numerous holes or passages in the anode, in order to maintain low current densities while achieving high current flow. However, extending the surface areas of anodes in this way is not practical for processes using consumable anodes because suitably perforated electrodes are expensive to fabricate. Moreover, a relatively simple current distribution calculation demonstrates that only a small fraction of the total extended anode surface, i.e. that near to the external surface, would carry any significant amount of current. As a result, high current densities at the external surfaces of the anode are likely to result in the production of chlorine or passivation of the anode surface, while the interior of the anode would make little contribution to the electrolysis of the oxide.

Consequently, prior attempts to carry out electrolysis of oxide during metal melting operations have not been particularly practical and the concept has not been adopted for commercial scale operations.

OBJECTS OF THE INVENTION

It is accordingly an object of the present invention to provide a commercially feasible process and apparatus for melting metals containing oxidizable elements in which oxide present on the metal surface or formed during the melting process is converted to the metal by direct electrolysis.

Another object of the invention is to provide a process and apparatus of this kind in which current densities can be raised to the levels required for conversion of the oxide at rates commensurate with acceptable throughputs required of commercial metal melters.

Another object of the invention, at least in its preferred forms, is to provide apparatus of the above kind in which the metal melting and oxide electrolysis can be carried out in the same vessel in an effective and efficient manner.

Yet another object of the invention is to provide a process of the above kind which can be carried out without the generation of large amounts of waste salt cake.

Yet a further object is to provide an improved process for recovering metal values from metal products containing large amounts of oxide, e.g. oxide-reinforced metal matrix composites and certain stabilized metal foams.

SUMMARY OF THE INVENTION

According to one aspect of the invention, there is provided a process of melting a metal that reacts rapidly with air at elevated temperatures to form a stable metal oxide and/or that contains a metal oxide prior to being exposed to elevated temperatures. The process comprises melting the metal while in contact with a molten metal salt mixture so that the metal oxide dissolves in the molten salt mixture and electrolysing the metal oxide contained in the molten metal salt mixture at an operational temperature above the melting point of the metal in order to convert the metal oxide to elemental metal. This is made possible at commercially acceptable rates by using a salt mixture which comprises at least 25% by weight of metal fluoride and has a composition which remains substantially unchanged during the electrolysis.

According to another aspect of the invention, there is provided apparatus for melting metal containing at least one metal element that reacts rapidly with air at elevated temperatures to form a stable metal oxide and/or that contains a metal oxide prior to being exposed to elevated temperatures. The apparatus comprises: a single refractory-lined vessel having sidewalls and a floor defining an interior volume for containing a molten layer of the metal and a molten layer of an electrolyte; at least one cathode in electrical contact with the molten metal and the electrolyte; at least one anode in electrical contact with the electrolyte; a feed zone for introducing the metal in solid form into the interior volume; an outlet for removing molten metal from the interior volume; and means applying electrolyzing potential between the cathode and the anode to electrolyze oxide contained in the electrolyte. The apparatus also includes at least one heat-resistant partition operationally separating a zone of the interior volume adjacent to the feed zone in which the metal melts during operation of the cell from a zone of the interior volume in which electrolysis of the oxide takes place, the partition permitting the electrolyte to recirculate between the melting zone and the electrolysis zone.

According to yet another aspect of the invention, there is provided a process of melting a metal matrix composite material containing a metal and particles of a metal oxide, comprising: melting the material in contact with a molten metal salt mixture so that the metal oxide dissolves in the molten salt mixture; and electrolysing the metal oxide contained in the molten metal salt mixture in order to convert the metal oxide to elemental metal; wherein the metal salt mixture comprises at least 25% by weight of metal fluoride.

By the term "metal containing at least one element which reacts rapidly with air at elevated temperatures to form a stable metal oxide", we mean in particular metals and metal alloys consisting essentially of or containing, either as major or minor components, metals such as aluminum, magnesium and lithium, which oxidize readily in metal decoating procedures and metal melting operations. Such elements not only oxidize quite rapidly, but also form stable oxides which are difficult to reduce by conventional means, such as carbothermal reduction. The metals and alloys containing such elements thus tend to undergo significant losses when recycled. Such metals include not only the so-called "light metal", but also copper- and tin-based alloys, such as bronzes and brasses. In particular, the process can be used to melt common Cu, Zn, Al and Mg based alloys as well as more "reactive" Al—Mg, Al—Li, Mg—Li, Cu—Al and Zn—Al alloys. The invention also relates to the melting of metals already containing or contaminated by metal oxides of any kind which may be electrolyzed during the process of the invention. Of course, the metals may both comprise oxidizable components and contain added oxide contaminants.

By the phrase "a composition which remains substantially unchanged during said electrolysis" we mean in particular a composition which is such that significant additions do not have to be made to the salt mixture during electrolysis, over and above those additions required to replace inevitable losses of the salt mixture, in order to compensate for variations in the composition of the electrolyte to keep the process operational.

The present invention makes it commercially feasible to carry out, in the same apparatus, simultaneous metal melting in the presence of a salt mixture and direct electrolysis of the oxide which accumulates in the salt mixture. Moreover, the apparatus can be kept to a physical size which is acceptable from the points of view of capital expenditure, energy efficiency and space utilization.

The invention also makes it possible to recycle metal values from metal matrix composites and metal foams reinforced with or stabilized by metal oxide particle or fibres, e.g. alumina.

DETAILED DESCRIPTION OF THE INVENTION AND THE PREFERRED EMBODIMENTS THEREOF

Figure 1:
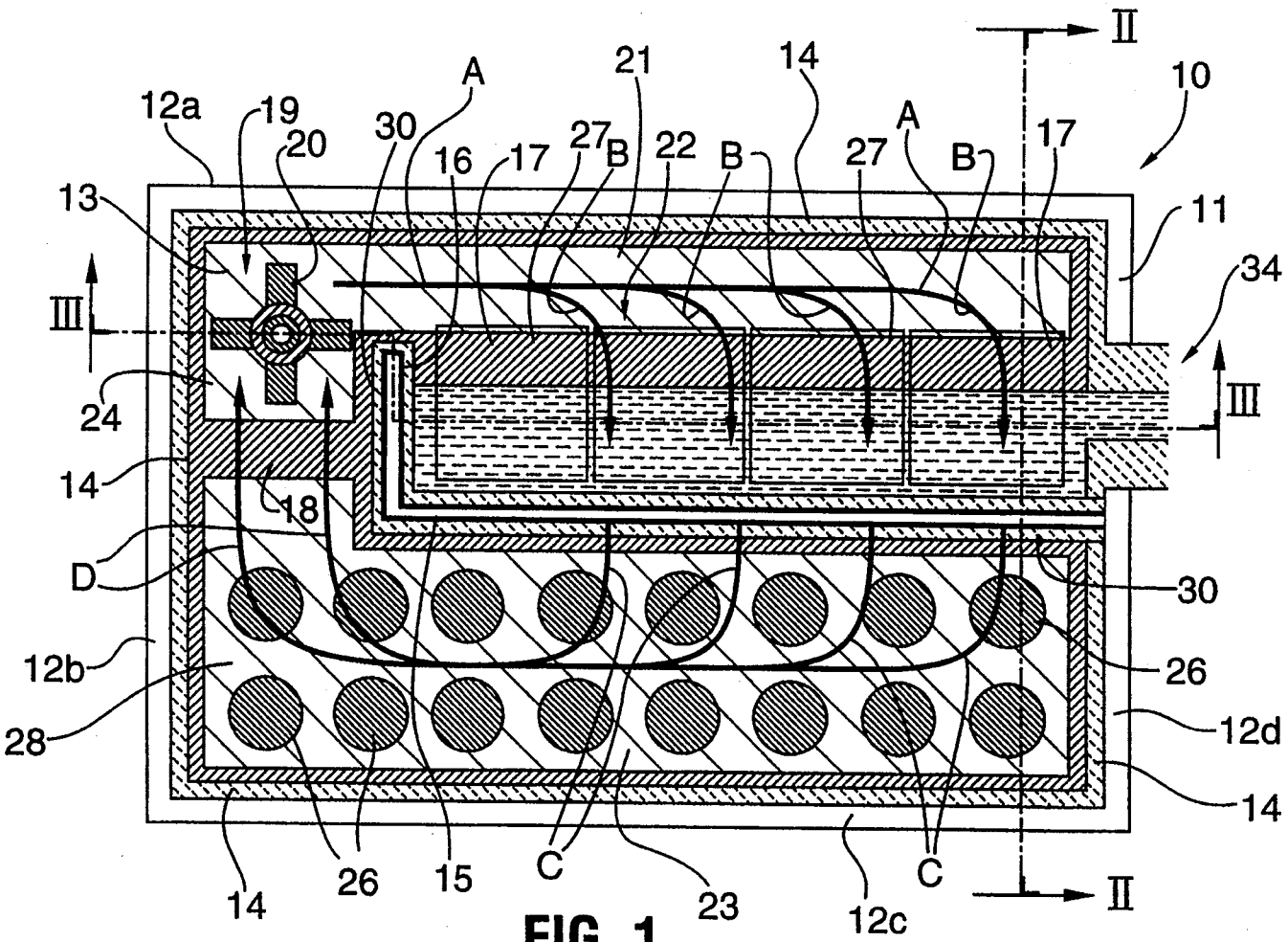
FIG. 1 is a top plan view of a preferred metal melter apparatus according to a first embodiment of the invention.

In the present invention, metal melting and oxide electrolysis are carried out essentially simultaneously, and preferably in the same reaction vessel, in the presence of a molten metal salt electrolyte, usually a salt mixture. Despite the difficulties mentioned earlier, it has been found possible to use current densities appropriate for commercial scale operations by carefully choosing an appropriate salt mixture used as the electrolyte.

The salt mixture should most preferably contain at least 25% by weight of a metal fluoride and have a composition which does not change significantly during the electrolysis and melting operations.

The use of a salt mixture which contains at least 25% by weight of metal fluoride increases the amount of oxide which may be dissolved in the salt mixture compared to conventional chloride-containing salt mixtures (e.g. those used as common salt fluxes), since metal oxides are generally more soluble in fluorides than chlorides. The increased oxide concentration in turn means that the limiting current density is effectively raised, making it possible to use higher current densities during the electrolysis. This is because decomposition of the salt mixture takes place only when the oxide dissolved in the salt mixture in the immediate region of the anodes is depleted. Higher salt solubilities result in a faster replenishment of the dissolved oxide in the region of the anodes, thus making oxide-depletion less likely.

As little as 25% by weight of fluoride in the salt mixture increases the solubility of the oxide sufficiently to permit useful increases in current densities without encountering undesirable anode effects. However, the use of a salt mixture made entirely of metal fluorides is particularly preferred in most cases because this not only maximizes the solubility of the oxide in the salt mixture, but also avoids any possibility of chlorine generation if the limiting current density is inadvertently exceeded. Instead, in such cases, the anode surface is temporarily passivated by the generation of an electrically insulating fluorine film on the anode and the current flow is temporarily reduced, which is more acceptable than chlorine generation, although of course still to be avoided, if possible. Furthermore, the presence of chlorides often makes the salt mixture much more hygroscopic than fluoride-only mixtures and, as a result, tends to make the mixture react with water vapor to produce HCl and oxide in the salt solution, which then has to be electrolyzed out.

Nevertheless, the presence of chloride components in limited amounts may be seen as advantageous in those cases where salt mixtures of reduced melting point are desired, since the presence of chlorides tends to lower the melting points of fluoride-containing salt mixtures.

As indicated above, a second important criterion of the electrolyte is the use of a salt mixture which remains stable in composition during the electrolysis. This is necessary because, if the composition changes, additional salt components have to be added in order to avoid increases in the solidification point of the salt mixture and consequent electrolyte freeze. In such cases, when those additions exceed salt losses due, for example, to evaporation, excess salt mixture has to be continually removed from the process and disposed of, giving rise to environmental problems and a loss of economy. In contrast, when the composition does not change, the salt mixture can be used for a prolonged period of time without disposal and with only minor additions necessary to make up for inevitable losses.

The composition of salt mixtures remains substantially unchanged during the electrolysis procedure if there is no exchange of cations between the metal and the salt mixture. This requires thermodynamic compatibility of all of the components of the metal being melted with all of the components of the salt mixture. In particular, any salt-metal exchange reactions should not result in excessive contamination of the metal with the electrolyte components, or in stripping of the metal components and composition changes in the electrolyte.

For example, magnesium in a metal alloy reacts with alkali ions $Na^+$, $Li^+$ and $K^+$ in the electrolyte to contaminate the metal with Na, Li or K, respectively. The relative concentrations of Mg in the alloy and K, Li or K ions in the salt mixture dictate whether the composition changes will be acceptable or not.

As another example, $Al^{3+}$ ions in the salt mixture react with any alkali or alkaline earth (and some of the rare earths) alloying elements in the metal. Hence, for alloys with significant Mg and Li contents, aluminum ion-containing salt mixtures should be avoided. However, for aluminum-containing alloys containing only more noble alloying elements, such as Cu, Fe, Mn and Zn, $Al^{3+}$ ion-containing salt mixtures are quite suitable and are, in fact, preferred because of their improved oxide solubility and low price.

Consequently, it can be seen that an appropriate choice of salt mixture must be made according to the metal to be melted so that the composition of the salt mixture remains substantially unchanged. As a general rule, the following salt systems can be used when melting the following types of metal alloys:

(1) for magnesium- and lithium-free aluminum alloys, a preferred salt system is $NaF—AlF_3$ with possible $Ca^{2+}$, $Mg^{2+}$, $K^+$ and $Cl^-$, additions, or cryolite ($Na_3AlF_6$);

(2) for lithium-free magnesium and aluminum alloys, a preferred salt system is $CaF_2—MgF_2$ with possible additions of $Na^+$, $K^+$, and $Cl^-$, e.g. equimolar $CaF_2$:$MgF_2$ (55.6 wt % $CaF_2$ and 44.4 wt % $MgF_2$) or 40.4 wt % $CaCl_2$, 33.2 wt % $CaF_2$ and 26.4 wt % $MgF_2$;

(3) for lithium and aluminum-lithium alloys, a preferred salt system is $LiF—CaF_2$ with possible additions of $Na^+$, $K^+$ and $Cl^-$;

(4) for magnesium-lithium alloys and aluminum-lithium-magnesium alloys, a preferred salt system is $LiF—CaF_2—MgF_2$, e.g. 40.6 wt % LiF, 22.9 wt % $CaF_2$ and 36.5 wt % $MgF_2$; and (5) for magnesium-lithium alloys, a preferred salt system is $MgF_2$—LiF.

The additions of cations $Ca^{2+}$, $Mg^{2+}$, $K^+$ and $Na^+$ can be made in the form of either metal fluorides, e.g. KF, or if simultaneous $Cl^-$additions are required, in the form of metal chlorides, e.g. KCl. The addition of $Cl^-$ anions can be made in the form of a chloride of any cation component of the electrolyte, e.g. $CaCl_2$, $MgCl_2$, NaCl, KCl, etc.

Using the above guidelines and a knowledge of the components of the metal, an appropriate salt mixture can be found for other scrap metals to be recycled.

Examples of common metal alloys which may be melted in the process of the present invention using appropriate salt mixtures as indicated above include the following:

(1) aluminum-based alloys, e.g. AA 1100, AA 3003 and AA 3102;

(2) aluminum-based alloys containing magnesium; e.g. most casting alloys; e.g. A 356 and A 390; as well as most wrought alloys, e.g. AA 5182, AA 6061, and AA 7075;

(3) aluminum-based alloys containing magnesium and lithium, e.g. AA 2090, AA 8090, AA 9092 and AA 8192;

(4) magnesium-based alloys, e.g. AZ 31B (3% Al), AZ 80A (8.5% Al), and all magnesium-based alloys containing no aluminum;

(5) copper-based aluminum bronzes, e.g. C60600 to C64400 (2.3 to 14% Al); and (6) zinc-based alloys containing aluminum, e.g. ZA8 to ZA27 (containing 9 to 28% by weight of Al).

The above considerations also apply to metal matrix composites or stabilized foams based on alloys of the stated types. The presence of fluorides in the salt mixtures assist in the separation and electrolysis of the considerable amounts of oxide present in these materials.

In the explanation provided above, it was indicated that exchange of metallic elements between the molten salt mixture and the molten metal should be avoided because it results in composition drift in the electrolyte. However, there is one case when cation interchange of this kind is desirable. This is when calcium-containing aluminum metal alloys are to be melted. Scrap aluminum alloy is often contaminated with Ca in the form of pigments, cement or clay and, after melting, may contain as much as 50 ppm of calcium when the aluminum metal is ready for recycling. It is desirable to reduce the level of calcium to about 5 ppm or less and this is conventionally done by reaction with chlorine with attendant pollution and dross formation. In the present invention, Ca reduction can be achieved by carrying out the melting procedure in the presence of a salt mixture containing a mixture of magnesium and calcium salts (preferably about 50 mole % of each). The Ca metal in the alloy exchanges with the $Mg^{2+}$ ions in the salt during melting and electrolysis and the Ca content of the metal is consequently reduced. However, the amount of cation exchange is relatively small (since the Ca-content of the alloy is not very great), and thus does not produce a significant composition change in the salt mixture, i.e. one which requires the addition of compensating components to avoid elevation of the solidification point.

While the process of the present invention can be used to melt metals and alloys containing "reactive" (highly oxidizable) elements, the process does not work well with alloys containing reactive elements having multiple valance states, e.g. titanium and chromium, when present in such large amounts that they form their oxides in preference to the oxides of other reactive elements in the alloy, e.g. Al or Mg. The reason is that these oxides convert to volatile fluorides and thus tend to be lost during the melting operation. Moreover, the multiple valence states makes it possible for the element to undergo oxidation and reduction during the electrolysis step without necessarily depositing elemental metal. However, these elements cause no problems if present in small amounts, e.g. less than 1% by weight. For example, aluminum-based alloys often contain minor amounts of Cr and Ti. Moreover, their oxides, $Cr_2O_3$ and $TiO_2$, are often present as pigments in coatings on scrap alloy. These oxides are reduced by Al or Mg contained in the alloy as the alloy is heated and melted, producing alumina or MgO and depositing metallic Cr or Ti in the molten metal at the cathode where they do not create a problem. (In fact, this is true of any oxide less stable than MgO, when Mg is present in the alloy, e.g. $Fe_2O_3$, $SiO_2$, NiO, etc.). Should the Ti or Cr oxide dissolve in the molten salt, then a very small activity of the multivalent fluoride salts of Ti or Cr would be realized. However, this should not present a problem because the vapor pressure of a salt with such low activity should itself be small. These salts would also not be stable in solution, except at a very small activity since any Mg in the alloy at the cathode would displace the Ti or Cr ions (of any valence state) into the metal alloy, with the Mg exchanging back into the salt according to the following reaction:

$$2Mg(\text{in alloy}) + Ti^{4+}(\text{in salt}) \rightarrow 2Mg^{2+}(\text{in salt}) + Ti(\text{in alloy})$$

Thermodynamic calculations show that the above reaction is driven to the right, regardless of the valence of Ti or other element that forms multivalent ions in the salt mixture.

On the other hand, alloys which contain elements that form multivalent ions, such as Ti and Cr, in such large quantities that their oxides are formed in preference to the oxides of single valence reactive metals, e.g. Al and Mg, may not be suitable for melting by the process of the invention.

While the considerations discussed above are the main ones dictating the choice of the salt mixture for use with particular alloys in the process of the present invention, there are several other considerations which should also preferably be taken into account, as indicated in the following.

The composition of the salt mixture should preferably also be chosen to produce an appropriate melting point or, more accurately, liquidus temperature. For reasons explained more fully below, the liquidus temperature of the salt mixture should preferably be no more than 50° C. below, and more preferably no more than 25° C. below, the operational temperature of the process.

The operational temperature is optimally the lowest temperature which permits the current density to be raised to such an extent, without encountering anode effects, that the rate of electrolysis of oxide equals or exceeds the combined rate of introduction of oxide into, and the rate of production of oxide during, the melting operation. This optimal temperature varies from electrolyte to electrolyte according to the solubility of the oxide in the molten salt mixture and other factors.

Once the components of the salt mixture have been determined for any particular metal to be melted, the relative proportions of the main salt components can be varied, and/or minor additions of other salts can be made, in order to vary the liquidus temperature of the salt mixture, as desired. A suitable liquidus temperature can be determined in this way from the salt phase diagram.

When employing minor amounts of other salts to adjust the liquidus temperature, e.g. salts containing $K^+$, $Na^+$ and $Cl^-$, due care must of course be taken to ensure that the amounts are not so great that compensating additions have to be made to the salt mixture in those cases where cation interchange may as a result take place.

While eutectic mixtures of the salt components may be employed in order to obtain the lowest possible liquidus temperatures, it is usually better to use non-eutectic mixtures so that small localized variations in the composition of the salt system do not necessarily result in rapid solidification of the mixture.

The appropriate operational temperatures for melting processes carried out with the stated salt mixtures used for melting the most commonly recycled metal alloys are shown in Table 1 below.

TABLE 1

| ALLOY TYPES | SALT SYSTEMS | OPERATIONAL TEMP. |
|---|---|---|
| Mg-free Al | $NaF—AlF_3$ | 800° C. |
| Al—Mg | $CaF_2—MgF_2$ | 1000° C. |
| Al—Mg—Li | $CaF_2—MgF_2—LiF$ | 800° C. |

As stated above, the maximum attainable concentration of oxide contained in the salt mixture is a most important factor which determines the limiting current density for the electrolysis. This concentration is affected not only by the choice of salt mixture, but also by the temperature of the salt mixture, because more oxide normally dissolves at higher temperatures in any given salt mixture. Moreover, the kinetics of the dissolution of the oxide also tend to increase with increasing temperatures. These factors combine to produce higher limiting current densities at higher temperatures if other factors remain the same.

However, elevated temperatures disadvantageously result in lower thermal efficiencies, decreasing electrolytic current efficiencies, increased salt evaporation losses and loss of volatile alloy components (e.g. Mg and Zn). Consequently, the operational temperature should desirably be no higher than is required to permit a suitably high rate of reduction of the oxide.

It will be appreciated that the optimal operating temperature will vary from system to system according to the salt mixtures employed because different salt mixtures have different oxide solubilities. For example, the solubility of the oxide in the $NaF—AlF_3$ system is significantly higher than that in the $CaF_2—MgF_2$ system, so the optimal operating temperature is lower in the former system. In the former system, operating temperatures of 800°-850° C. may be used, whereas in the latter system an operational temperature of 1000° C. is preferred even though minor chloride additions could be used to significantly lower the 970° C. salt eutectic temperature. Chloride additions drastically reduce oxide solubility and permit $Cl_2$ evolution at the anode with no passivation effect in those cases where the limiting current density is inadvertently exceeded. These effects are undesirable.

For most systems, the operational temperature falls within the range of 790°-1200° C., more usually 900°-1000° C., in both the melting and electrolysis zones. Temperatures significantly lower than 790° C. may be used in appropriate cases, but when melting aluminum-containing alloys, temperatures above 750° C. are generally preferred in order to achieve a sufficiently rapid melting rate.

As will be apparent from the discussion above, it can be stated that the main factor which influences the limiting current density is the mass transportation of the dissolved oxide to the region immediately adjacent to the anodes. While this is a function of temperature and concentration, as already explained, it can also be affected by agitation or movement of the salt mixture. This not only helps the dissolved oxide to disperse evenly within the salt solution, but may also bring undissolved solid particles of oxide into the region of the anodes. This ensures that the salt mixture remains saturated with dissolved oxide and, when these solid particles dissolve, the resulting dissolved oxide quickly replenishes the oxide consumed by the electrolysis in the region of the anodes, reducing the likelihood of the generation of anode effects. It is, therefore, desirable to operate the process in such a way that the molten salt mixture is agitated or kept in motion so that dissolved and undissolved oxide is constantly moved from the region where the oxide is introduced or formed to the region immediately adjacent to the anodes.

This can be achieved by mechanical agitation means, e.g. a rotary impeller, and suitable means for guiding the resulting flow of the salt mixture to the region of the anodes. Alternatively, it would also be possible to use forced convection, thermal convection, gas lift around the anodes or magnetic stirring to produce suitable agitation and circulation of the molten salt mixture.

Similar means can also be used to draw solid metal pieces quickly below the surface of the molten salt mixture or molten metal layer. This is advantageous because oxidation may take place if the solid metal is exposed to the air as it is heated. For example, an impeller provided for the purpose indicated above may also be used to create a vortex in the region where the solid metal is introduced. Alternatively, a compacted rod made of solid metal pieces may be forced below the surface of the salt mixture or molten metal layer.

When the solid metal contacts the molten salt solution, the salt solution adjacent to the metal quickly freezes, forming a solid layer around the metal piece and this layer thickens as the metal melts and extracts heat of fusion from the adjacent salt mixture. This frozen salt layer must be remelted before the molten metal inside can coalesce with other metal droplets and before the coating oxide layer can be transferred to the molten salt mixture. It is therefore usually desirable to provide a melting zone separate from the electrolysis zone in the apparatus used for the operation of the process. This melting zone should be adjacent to the inlet zone where the solid metal is introduced, and should be of such dimensions that the solid freeze formed on the metal pieces melts before the surrounding salt mixture enters the electrolysis zone.

From the above description it will be appreciated that, if the process is to be carried out in a single vessel (as desired), the vessel should be divided into at least two zones by one or more internal partitions which allow the molten salt solution to recirculate between the zones at a suitable rate of flow.

The need for such internal partitions, in the preferred apparatus, is the reason why the liquidus temperature of the salt mixture should preferably be no more than 50° C. lower than the operational temperature of the process. This is because molten fluoride-containing salts at high temperatures have powerful solvent capabilities and rapidly attack most refractory materials used for lining electrolysis cells and the like. This attack can be prevented by providing a layer of solid salt mixture (so-called "freeze") on the surfaces of the apparatus subject to attack. In the case of external walls of the apparatus, where heat loss can be designed to ensure that the layer of freeze forms during use with no active cooling. However, internal partitions are not subject to heat loss and should therefore be cooled, e.g. by passing a cooling gas through internal cavities. If the liquidus temperature is within 50° C. of the operational temperature of the cell, and particularly within 25° C. of the operational temperature, the required freeze layer can be formed on the internal partitions without too much difficulty and energy loss.

A protective layer of salt freeze may not be necessary in all of the zones of the apparatus, however, so cooling of all of the internal partitions may not be required. In particular, a layer of protective salt freeze is not required where the molten metal contacts the partitions or apparatus walls. Furthermore, in the melting zone of the apparatus, the salt mixture tends to become supersaturated with oxide and this reduces attack of the partition and apparatus walls by the salt mixture. It will be appreciated that it is particularly advantageous to avoid cooling of the walls surrounding the melting zone because this removes heat from the zone and consequently less is available for rapid melting of the metal and the coating layer of solid salt mixture. However, the salt freeze is required for protection in the electrolysis zone of the apparatus.

It should be noted that the densities of the preferred salt systems can vary considerably and some may be less dense than the molten metal with which they are intended to be used, whereas others may be more dense. This means that, in some systems, the molten metal will float on top of the molten salt mixture, whereas in other systems, the molten metal will be submerged below the molten metal salt mixture. Either arrangement may be used in the process of the present invention. When the molten salt mixture floats on top of the molten metal layer, it is easy to see how the salt system protects the metal from oxidation by acting as a barrier. However, when the molten metal floats on top of the salt, protection is still afforded because the molten salt "wicks" around the metal layer (due to the similarity in densities between these layers) and forms a thin salt film at the metal surface. This thin film prevents molten metal from wicking into a newly forming oxide layer and thus prevents further oxidation.

In Table 1 above, the first salt system ($NaF—AlF_3$) is less dense than magnesium-free aluminum alloys, so the molten salt system floats on top of the molten metal layer. In the case of the other salt systems, the molten salt is more dense than the indicated metals, so the molten metal layers float on top of the salt mixtures. In the case of apparatus intended to accommodate the process in which the molten metal layer floats on top of the molten salt material, further partition means are also required to physically separate the molten metal layer from the anodes. Such partitions should, of course, be electrically insulating in this case.

It is possible, using conventional solid (imperforate) anodes and the salt systems indicated above, together with high operational temperatures and agitation of the salt system, to achieve current densities of 0.1 Amp/cm$^2$ or more (e.g. 0.1–1.0 Amp/cm$^2$) using conventional current generating apparatus without encountering any anode effects (e.g. a sharp reduction in current flow due to passivation of the anode by fluorine emission, or evolution of chlorine gas). Current densities of this nature mean that the metal melting apparatus may be made physically small enough and suitably thermally efficient to make practical operation commercially feasible.

The heat required for the melting of the metal, at least after an initial start-up period, is provided completely "subsurface" to maximize operational efficiency and minimize heat losses to the surrounding atmosphere. For example, the heating can be provided entirely by electrical resistance heating created by the current flowing through the molten salt electrolyte between the anodes and cathodes. This current may be alternating current with a DC bias necessary to bring about the required oxide reduction. More preferably, however, the current is DC entirely, although AC may be made available when the concentration of oxide in the molten salt layer is likely to be low, for example during interruptions of the feed of metal to the melting apparatus. The application of AC at such times maintains the desired heating in order to prevent cell freeze-up, but avoids the production of anode effects.

It is also possible to supplement or replace the resistance heating by induction heating using electrical coils embedded in the walls of the apparatus.

A still further consideration to reduce oxidation and heat losses during the melting operation is to minimize the area of salt mixture and/or molten metal exposed to the atmosphere so that oxygen absorption and hydrolysis of the salt mixture is minimized. This can be achieved by suitably designing the apparatus. For example, exposed liquid surfaces can be reduced by designing anodes and/or cathodes to cover as much of the exposed upper surface of the apparatus as possible. Furthermore, immersed or floating refractory lids may be used to cover exposed liquid surfaces. Immersed anodes, cathodes and/or lids have the additional advantage of being able to control the active volume of the zones within the apparatus and hence critical liquid levels. However, ideally, a sufficient gap should be left between adjacent anodes, and between the outside anodes of a group and an adjacent apparatus wall, to permit free flow of the molten salt mixture around all of the anodes and to permit $CO_2$ gas to escape as well as gas lift mixing of the electrolyte between the anodes. This also ensures good mass transportation of the oxide to the region of the anodes.

A more thorough understanding of the apparatus of the present invention can be obtained from the following description of preferred embodiments.

Figure 2:
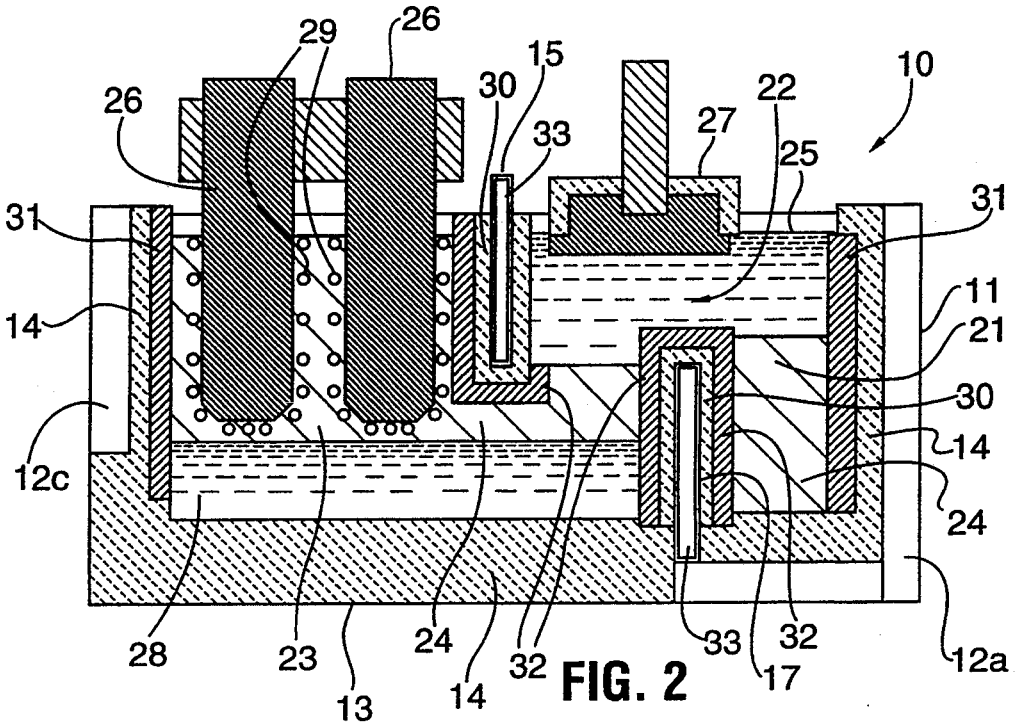
FIG. 2 is a vertical transverse cross-section of the apparatus of FIG. 1 taken on the line II—II of FIG. 1.
Figure 3:
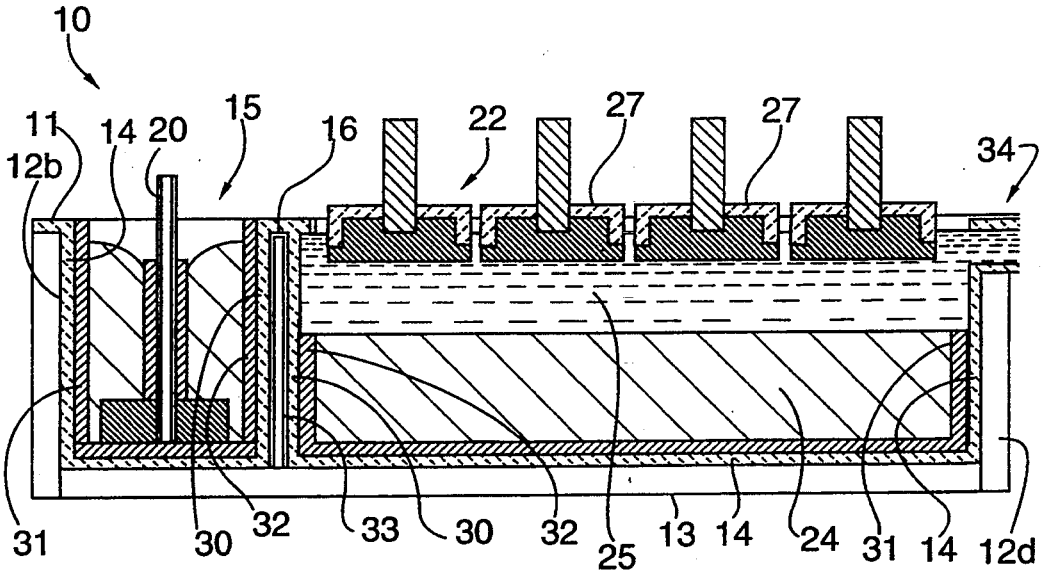
FIG. 3 is a vertical longitudinal cross section of the apparatus of FIG. 1 taken on the line III—III of FIG. 1.

FIGS. 1 to 3 show a cell designed to operate with a floating layer of molten metal. The melter 10 comprises a vessel formed by an outer metal shell 11 made up of side walls 12*a*, 12*b*, 12*c* and 12*d* and a floor 13, all of which are lined internally by a layer 14 of refractory material, such as alumina. The internal volume of the melter is divided into distinct zones by a number of partitions, some of which extend vertically over the entire height of the internal volume of the melter, and others of which extend only for part of the vertical height of the internal volume, either from above, leaving a gap beneath the partition, or from below, leaving a gap above the partition. A central longitudinal partition 15 is of the former type and extends into the internal volume of the melter from above, leaving a gap beneath the partition. A transverse partition 16, forming a continuation of one end of partition 15, extends over the full height of the internal volume of the melter. Longitudinal partition 17 projects vertically upwardly from the melter floor 13 but only for part of the height of the internal volume and is thus submerged beneath the upper surface of the cell contents. A similar submerged partition 18 extends from transverse partition 16 to sidewall 12*b* of the shell.

These partitions divide the internal volume of the shell into several distinct zones. First of all, partitions 16 and 18 define an inlet zone 19 in one corner of the shell, where solid metal pieces (not shown) are introduced into the melter. This zone contains an impeller 20 which is made of a material capable of withstanding high temperature and attack by the salt solution and molten electrolyte.

Submerged longitudinal partition 17 and the adjacent side wall 12*a* of the shell 11 define an elongated melting zone 21 extending for the full length of the melter in the lower part of the internal volume of the shell. Longitudinal partition 15 and submerged longitudinal partition 17 define a cathode zone 22 which extends between the immersed partition 15 and the submerged partition 17. On its opposite longitudinal side, the central longitudinal partition 15 defines an anode zone 23 with the adjacent sidewall 12*c* of the shell 11. Submerged longitudinal partition 18 separates the anode zone 23 from the inlet zone 19, although the cell contents may pass between these zones over the top of this submerged partition.

The cell contents in the various zones are explained as follows. First of all, inlet zone 19 contains a molten salt mixture 24 as well as solid metal pieces (not shown) newly introduced into the shell. Impeller 20 draws the solid metal pieces quickly below the surface of the molten salt mixture and mixes the molten metal salt and the solid metal pieces together and drives the mixture horizontally along melting zone 21 as shown by arrow A. As the metal pieces in the melting zone 21 melt and coalesce, they form a molten metal layer 25 (see FIG. 2) which floats on top of the molten salt mixture 24. Because the longitudinal partition 17 is submerged, the molten metal layer extends into the cathode zone 22 at the upper surface of the internal volume. In the melting zone 21, any oxide originally coating the metal pieces becomes detached from the molten metal droplets, and collects in the molten salt mixture, which preferentially wets the oxides. Some of the oxide dissolves in the molten salt mixture, and the remainder is suspended as small particles.

As more molten salt mixture is driven by the impeller 20 into the melting zone 21, the salt mixture eventually passes over the top of submerged partition 17 beneath the molten metal layer 25 into the cathode zone 22 (as indicated by Arrows B in FIG. 1) and from there into anode zone 23 beneath longitudinal partition 15, as indicated by Arrows C. The anode zone 23 contains anodes 26 dipping into the molten salt mixture from above the cell. Similarly, cathode zone 22 contains cathodes 27 dipping into the molten metal layer 25 from above.

As shown in FIG. 2, the lower region of the internal volume of the cell between submerged longitudinal partition 17 and side wall 12*c* of the shell contains a layer 28 of aluminum/copper alloy (or aluminum/magnesium/copper alloy when melting Mg-containing scrap).

Molten salt mixture 24 in the cathode and anode zones is electrolyzed by the passage of current between the anodes 26 and cathodes 27. This decomposes metal oxide dissolved and suspended in the molten salt mixture and results in the generation at the anodes 26 of carbon dioxide gas 29 (formed electrolytically by the reaction of dissolved oxide with the carbon of the anodes 26) and the generation of molten metal at the cathodic interface of the molten metal layer 25 with the electrolyte 24.

The layer of aluminum/copper alloy 28 helps to distribute the current passing from the cathodes 27 to the anodes 26, thus reducing the localized current density, thus making it less likely that the limiting current density of the electrolyte will be exceeded in any parts of the cell. The layer 28 functions by acting as an intermediate electrode so that liberated metal first joins the metal layer 28 and then is again electrolytically transformed from this layer to the cathodic metal layer 25 around the cathode. The copper in the alloy layer 28, which remains constant in amount throughout the process, makes this molten alloy more dense than the salt mixture 24, so that the layer 28 remains on the floor of the melter.

The oxygen is liberated at the carbon anodes 26 as carbon dioxide causing the anodes to be continuously consumed. To compensate for this, the anodes 26 are continuously or intermittently lowered into the internal volume of the melter, and new anode sections may be added to the tops of the anodes, as required.

The carbon cathodes 27 are not consumed during the electrolysis process, so they do not need to be replenished. However, it is desirable also to make the cathodes 27 vertically movable to control displacement of product metal 25 from the cell, as desired.

The impeller 20 maintains a continuous flow of the molten salt mixture 24 into the melting zone 21, the cathode zone 22, the anode zone 23 and back to the inlet zone 19 (Arrows D). This flow is strong enough to keep oxide particles suspended in the molten salt mixture 24 in inlet zone 19, melting zone 21 and around the anodes 26 so that localized oxide depletion in the molten salt mixture does not take place, thus avoiding development of anode effects.

As shown in the drawings, the partitions 15, 16, 17 and 18 are each provided with external layers 30 of refractory material, such as alumina, in order to provide heat-resistance. This refractory material may be similar to the refractory material 14 provided on the inner side walls and floor of the shell 11. However, the refractory materials 14 and 30 dissolve in the molten salt solution unless protected by solidified layers of the molten salt mixture. Such layers 31 form on the side walls 12*a*, 12*b*, 12*c* and 12*d* of the cell because heat-loss through these walls is designed to make them cool enough to freeze the adjacent salt mixture. However, similar layers 32 are formed on the outer surfaces of the partitions 15, 16, 17 and 18 only if these partitions are actively cooled, which is achieved by passing a cooling gas, such as air, through the hollow interiors 33 of these partitions. This can be achieved by suitable blower and conduit means (not shown). In fact, it may be unnecessary to provide submerged partition 18 with such cooling since the molten salt solution 24 in the inlet zone 19 is saturated with oxide and is thus unlikely to dissolve the refractory coating layer 30 on this partition. Moreover, cooling in this zone extracts heat from the inlet zone and thus retards melting of the input metal pieces.

Molten metal is continuously or periodically extracted from the melter via gate or launder 34, preferably after passing under a short partition dipping into the layer 24 of molten metal from above (not shown). In the case of periodic discharge, the level of immersion of cathode 27 and a floating lid (if present) in the product metal pool 25 is varied to accommodate the product metal within the melter and then to displace it out, when desired, without changes in the levels of the internal liquid layers.

In the illustrated melter, the area of exposed molten metal layer 24 is kept to a minimum in order to avoid reoxidation of the metal. Most of the metal surface is covered by cathodes 27, but a narrow exposed area is provided on each longitudinal side of the cathodes to allow clearance for possible salt freeze on the adjacent partition or shell sidewall. In fact, on the side of the cathodes 27 above the melting zone 21, a greater spacing may be provided (as shown) in order to provide access to the melting zone from above in order to permit stirring of, or sludge removal from, the melting zone 21. If desired, this gap may be covered by a floating lid (not shown) to reduce the area of exposed metal when access to the melting zone 21 is not required.

In the anode zone 23, the upper surface of the salt mixture 24 is blanketed by the $CO_2$ gas generated at the anodes and this provides protection from exposure to air and moisture. The anodes 26 may therefore be spaced quite widely from each other and the adjacent cell surfaces, which is desirable in order to allow the salt mixture to flow freely to all surfaces of the anodes, assisted by the gas lift caused by the $CO_2$ generation.

The cell can be operated continuously for a long period of time since the composition of the salt mixture 24 does not vary considerably with time and thus does not require replacement or removal. High current flow is made possible partly by providing a large number of anodes 26 in the anode zone 23 and cathodes 27 in the cathode zone 22, thus ensuring a large total electrode surface area, partly by operating the melter at a high temperature in the range of 790° to 1200° C., partly by using a fluoride-containing salt mixture 24 having high solubility for metal oxide, and partly by creating a strong recirculation of the metal molten salt mixture 24 throughout the various zones of the cell by impeller 20 which keeps undissolved oxide particles in suspension in the molten salt mixture.

The molten alloy layer 28 also remains constant in composition and volume during the operation of the cell and hence does not need to be frequently adjusted.

The advantage of the melter shown above is that it contains all of the necessary treatment zones in a single vessel or housing while accommodating a high current flow. The equipment can, therefore, be made of a practical size while still permitting a commercially-attractive rate of throughput.

Figure 4:
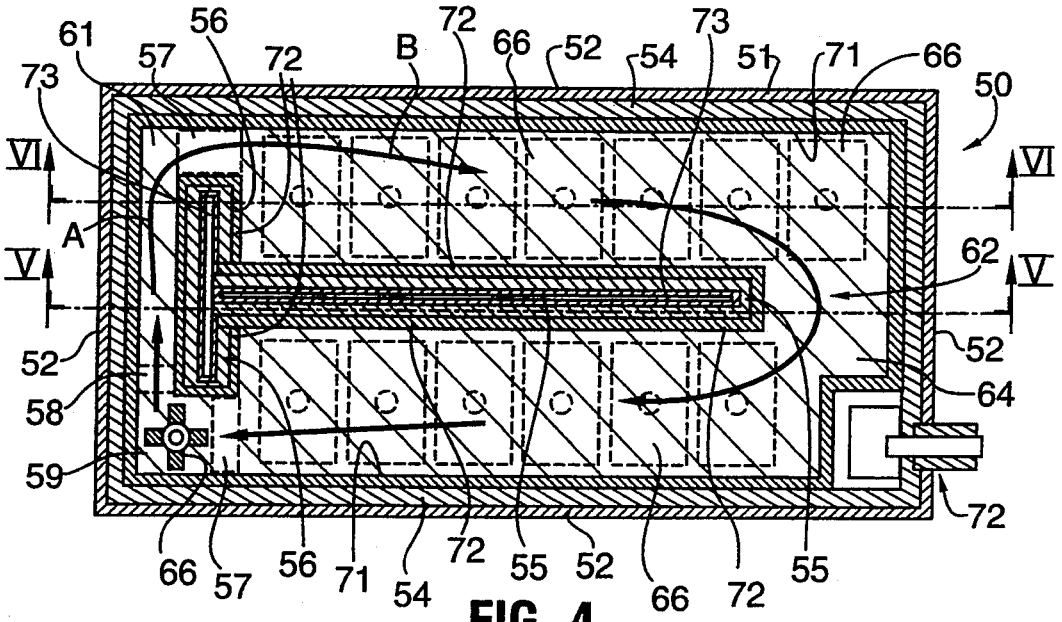
FIG. 4 is a plan view of a preferred metal melter apparatus according to a second embodiment of the invention.
Figure 5:
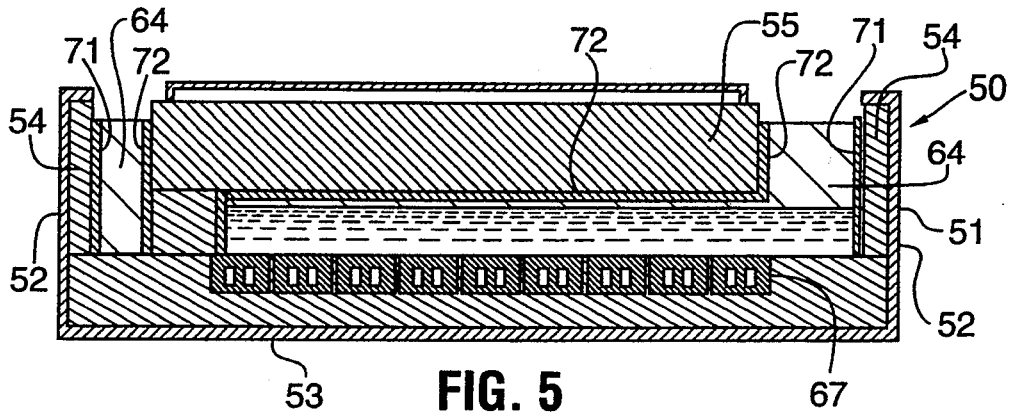
FIG. 5 is a vertical longitudinal cross-section of the apparatus of FIG. 4 taken along the line V—V.
Figure 6:
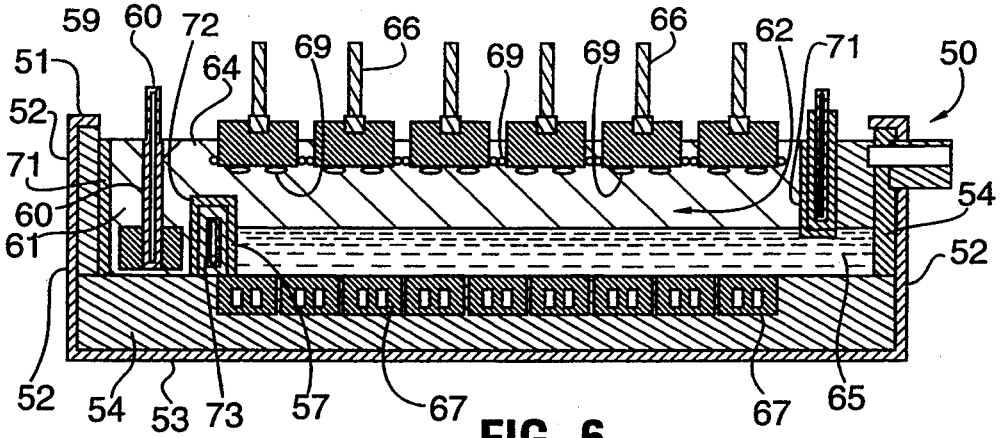
FIG. 6 is a vertical longitudinal cross-section of the apparatus of FIG. 4 taken along the line VI—VI.

FIGS. 4 to 6 illustrate a cell capable of carrying out the process of the invention when the density of the molten salt mixture is less than the density of the molten metal. In this case, the melter 50 consists of a vessel made of shell 51 comprising sidewalls 52 and floor 53, each being lined with a layer 54 of refractory material.

The cell has a central longitudinal partition 55 and a transverse partition 56 adjacent to one end of the melter. The transverse partition 56 does not extend completely to the adjacent sidewalls 52 of the shell, but connects with short submerged partitions 57 in these regions. A further submerged partition 58 extends between transverse partition 55 and the adjacent sidewall 52 at one transverse end of the partition 56.

Submerged partition 58 and adjacent submerged partition 57 define an inlet zone 59 containing an impeller 60. A melting zone 61 is defined between transverse partition 56, the adjacent sidewall 52 of the shell and inlet zone 59.

The remainder of the cell comprises an electrolysis zone 62 provided with anodes 66 dipping into the internal volume of the shell from above and cathodes 67 lining the floor of the melter.

Solid metal pieces are introduced into the melter in the inlet zone 59 and are mixed with molten salt mixture 64. Impeller 60 drives the resulting suspension into the melting zone 61 (Arrow A) where the metal pieces melt and the oxide from the metal pieces mixes with the molten salt mixture. The resulting suspension then passes into the electrolysis zone 62 (Arrow section B) and the molten salt mixture is electrolyzed, forming $CO_2$ gas 69 at the anodes 66 and a molten layer of metal 65 which collects on the cell floor of the melter.

The molten metal may be continuously or intermittently tapped from the melter through draining well 74.

As in the cell design first described above, the impeller 60 guarantees a strong flow of molten salt mixture 64 through the various zones of the melter and particularly around the anodes 66. This keeps the undissolved oxide particles in suspension in the molten salt mixture, thus making it possible to maintain a high current density through the cell.

Furthermore, as also described in the first embodiment, partitions 55, 56, 57 and 58 also have hollow interiors 73 for the passage of a cooling gas to create protective layers of salt freeze 72. Similar protective layers of salt freeze 71 are formed on the side walls 52 of the shell.

The invention is illustrated in yet further detail by reference to the following Example which should not be construed as limiting the scope of the present invention.

EXAMPLE

Figure 7:
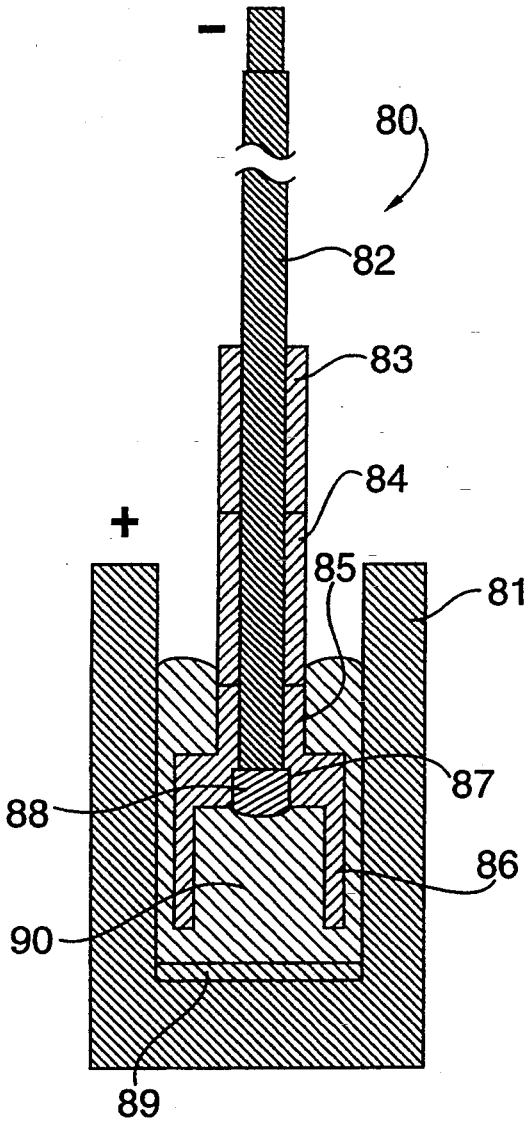
FIG. 7 is a cross-section of a laboratory scale apparatus used to carry out the procedure described in the Example below.

A laboratory-seal experiment was carried out using the apparatus 80 shown in FIG. 7. Although not shown, this apparatus was completely enclosed in an Inconel tube, which was sealed from the atmosphere and holds a flowing, inert argon gas.

The apparatus consisted of a graphite crucible 81 into which a graphite rote 82 projected from above. The graphite rod 82 was enclosed at its lower end within cylinders 83,84 and 85 made of boron nitride. The lower most cylinder 85 extended into an inverted cup 86 which caused stirring of the crucible contents when the graphite rod and enclosing cylinders were rotated. The lowermost tip of the graphite rod 82 was exposed to the crucible contents at the centre by the inverted cup 86, which was provided with a recess 87 to collect molten metal 88. A boron nitride disk 89 was cemented onto the bottom inner surface of the crucible in order to electrically insulate the bottom surface, thus preventing evolved $CO_2$ gas from re-oxidizing the metal cathode. The graphite crucible 81 served as the anode and the graphite rod 82 served as the cathode. The apparatus did not contain a separate melting zone because (a) the experiment was to be carried out batchwise rather than continuously, and (b) the experiment was to use an addition of alumina to simulate the oxide from scrap metal and no metal was, in fact, to be melted.

The crucible contained an electrolyte 90 comprising a molten equimolar mixture of $MgF_2$ and $CaF_2$ held at a temperature of 1015°. Curves of current density versus cell voltage were obtained by scanning the voltage at a rate of 1 V/sec.

The experiment was carried out as follows.

Figure 8:
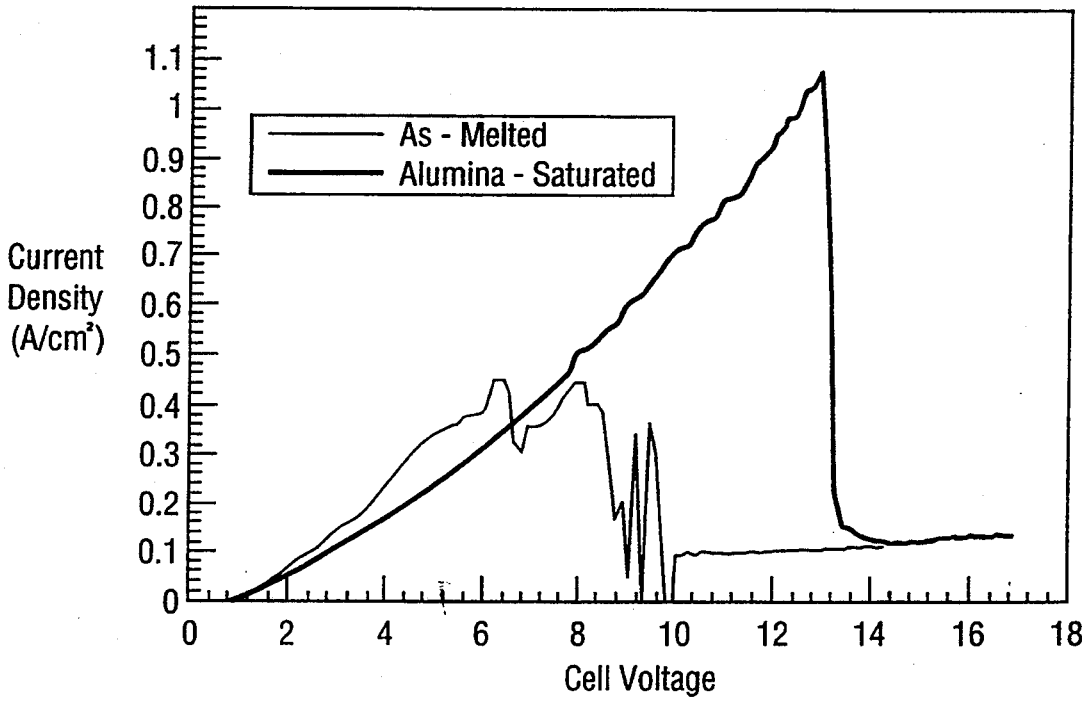
FIG. 8 is a graph showing the results of tests carried out in the Example.

After the salts were mixed and melted, the graphite rod 82 and attached boron nitride cylinders and cup were lowered into the electrolyte and rotated to ensure a uniform composition. Voltage headings ere taken with the cathode stationary, immediately after stirring, so as not to add spurious noise to the measured signal. The results of this voltage sweep on the freshly melted electrolyte is shown in FIG. 8 as the "As-melted" curve. Some current was passed as a result of impurities contained in the salt.

After electrolyzing to obtain a clean bath, an alumina addition was made in sufficient quantity to saturate the electrolyte, simulating the electrolyte composition encountered in a commercial-scale matter. The electrolysis was commenced and the second curve in FIG. 8, labelled "Alumina-saturated" was measured This curve shows that current densities can be raised to near 1.1 $A/cm^2$ before anode effects, carried by Fluoride decomposition, are encountered. The anode effect, when encountered, carried the current density to fall to about 0.1 $A/cm^2$.

This experiment shows that high circuit densities can be obtained using a fluoride electrolyte. The oxide can dissolve at a sufficiently high rate to support the electrolysis at such current densities.

We claim:

1. A process of recovering a metal from scrap material containing metal that is contaminated with metal oxide or that reacts rapidly with air at elevated temperatures to form a stable metal oxide, which process comprises:

heating said scrap material in contact with a molten mixture of metal salts to melt said metal contained in said scrap material and to dissolve any contaminating metal oxide contained in said scrap material, and any metal oxide formed on said metal during said heating of said scrap material, in said molten salt mixture;

while melting said metal, electrolyzing said metal oxide dissolved in said molten salt mixture at an operational temperature above a melting point of said metal to convert said metal oxide to elemental metal; and separating said molten metal from said metal salt mixture;

wherein said metal salt mixture contains substantially no metal oxide from sources other than said scrap material, comprises at least 25% by weight of metal fluoride and has a composition which remains substantially unchanged during said electrolysis.

2. A process according to claim 1 wherein said metal salt mixture consists essentially of metal fluorides.

3. A process according to claim 1 wherein said metal is a magnesium- and lithium-free aluminum-containing alloy and said metal salt mixture comprises cryolite or a mixture of NaF and $AlF_3$.

4. A process according to claim 1 wherein said metal is a lithium-free magnesium or aluminum alloy and said metal salt mixture comprises a mixture of $CaF_2$ and $MgF_2$.

5. A process according to claim 1 wherein said metal is lithium or an aluminum-lithium alloy and said metal salt mixture comprises a mixture of LiF and $CaF_2$.

6. A process according to claim 1, wherein said metal is a magnesium-lithium alloy or an aluminum-magnesium-lithium alloy and said metal salt mixture comprises a mixture of LiF, $CaF_2$ and $MgF_2$.

7. A process according to claim 1 wherein said metal is an aluminum alloy containing about 50 ppm or less of calcium and said metal salt mixture comprises a mixture of magnesium and calcium salts.

8. A process according to claim 1 wherein said operational temperature is a temperature which permits said electrolysis of said oxide contained in said metal salt mixture to take place at a rate at least equal to a rate of introduction of said oxide into said metal salt mixture.

9. A process according to claim 8 wherein said operational temperature is within the range of 790°–1200° C.

10. A process according to claim 8 wherein said metal salt mixture has a liquidus temperature no more than 50° C. below said operational temperature.

11. A process according to claim 8 wherein said metal salt mixture has a liquidus temperature no more than 25° C. below said operational temperature.

12. A process according to claim 1 wherein said metal salt mixture is a non-eutectic salt mixture.

13. A process according to claim 1 wherein at least one anode used for said electrolysis contacts said metal salt mixture and wherein said metal salt mixture is kept in motion to ensure saturation of said metal salt mixture with said metal oxide and circulation of saturated metal salt mixture to said at least one anode.

14. A process according to claim 13 wherein said metal salt mixture is agitated during said melting and electrolyzing steps to maintain undissolved oxide particles in suspension in said metal salt mixture and to convey said suspended oxide particles to said at least one anode.

15. A process according to claim 1 wherein said metal is in the form of a plurality of pieces and said pieces are submerged in said metal salt mixture before melting takes place.

16. A process according to claim 1 wherein said melting step and said electrolyzing step are both carried out in a single vessel provided with a melting zone and an electrolysis zone operationally separated from, but within fluid communication with each other to permit said metal salt mixture to recirculate between said zones.

17. A process according to claim 16 wherein said zones are separated from each other by at least one internal partition in said vessel, and wherein said partition is cooled to cause said metal salt mixture to solidify on surfaces of said at least one partition.

18. A process according to claim 1 wherein said metal salt mixture is less dense than said metal when molten.

19. A process according to claim 1 wherein said metal salt mixture is more dense than said metal when molten.

20. A process according to claim 1 wherein anodes are used for said electrolysis step and wherein said anodes are substantially imperforate.

21. A process according to claim 20 wherein a plurality of said anodes are provided, said anodes being separated from each other to permit said metal salt mixture to flow freely between said anodes and to permit gas to escape from said anodes.

22. A process according to claim 1 wherein heat employed to melt said metal and to raise said metal salt mixture to said operational temperature is heat generated within said metal salt mixture or said metal by electrical means.

23. A process according to claim 1 wherein said at least one metal element comprises an element having only a single stable valency and wherein said metal contains only such small amounts of one or more additional reactive metal elements having a plurality of stable valencies that oxides of said additional reactive metal elements are not formed in preference to oxides of said at least one metal element having only a single valency.

24. A process according to claim 1 wherein said metal is a continuous phase of a metal matrix composite reinforced by oxide particles.

25. A process according to claim 1 wherein said metal is a metal foam product stabilized by particles of metal oxide.

26. Apparatus for melting metal containing at least one metal element that reacts rapidly with air at elevated temperatures to form a stable metal oxide or that contains a metal oxide prior to being exposed to elevated temperatures, said apparatus comprising:

a single refractory-lined vessel having sidewalls and a floor defining an interior volume for containing a molten layer of said metal and a molten layer of metal salts mixture;

at least one cathode in electrical contact with said molten metal and said salt mixture;

at least one anode in electrical contact with said salt mixture;

a feed zone for introducing said metal in solid form into said interior volume;

an outlet for removing molten metal from said interior volume; and means applying electrolyzing potential between said at least one cathode and said at least one anode to electrolyze oxide contained in said salt mixture;

said apparatus including at least one heat-resistant partition means operationally separating a zone of said interior volume adjacent to said feed zone in which said metal melts during operation of said cell from a zone of said interior volume in which electrolysis of said oxide takes place, said partition means permitting said salt mixture to recirculate between said melting zone and said electrolysis zone.

27. Apparatus according to claim 26 wherein said at least one partition means incorporates internal cavities for receiving a cooling fluid therein to cause said metal salt mixture to solidify on surfaces of said partition means.

28. Apparatus according to claim 26 comprising impeller means for agitating said metal salt mixture and causing said metal salt mixture to flow between said melting zone and said electrolysis zone.

29. Apparatus according to claim 26 comprising at least one additional partition means in said internal volume for control of said metal salt mixture flow to said anodes.

30. Apparatus according to claim 26 comprising at least one additional partition means in said internal volume, said additional partition means being electrically non-conducting and positioned to separate said molten layer of said metal from said anodes.

31. Apparatus according to claim 26 wherein said at least one anode is movable into said internal volume to compensate for anode consumption during use.

32. Apparatus according to claim 26 wherein said at least one cathode is movable into or out of said internal volume to control liquid levels in said internal volume and discharge of product metal.

33. Apparatus according to claim 26 further comprising removable floating covers for covering areas of said metal or said metal salt mixture exposed to external atmosphere.

34. Apparatus according to claim 26 further comprising removable immersed covers for covering areas of said metal or said metal salt mixture exposed to external atmosphere.

35. Apparatus according to claim 26 comprising electrical means for generating heat within said molten layer of said metal or said metal salt mixture.

36. A process of recovering a metal from a metal matrix composite material containing a metal and particles of a metal oxide, comprising:

heating said composite material in contact with a molten mixture of metal salts to melt said metal contained in said composite material and to dissolve said metal oxide, and any oxide that forms on said metal during said heating of the composite material, in said molten salt mixture;

while melting said metal, electrolyzing said metal oxide dissolved in said molten salt mixture to convert said metal oxide to elemental metal; and separating said molten metal from said metal salt mixture;

wherein said metal salt mixture contains substantially no metal oxide from sources other than said metal scrap, comprises at least 25% by weight of metal fluoride and has a composition which remains substantially unchanged during said electrolysis.

* * * * *